US006178932B1

(12) United States Patent
Matsuda et al.

(10) Patent No.: US 6,178,932 B1
(45) Date of Patent: Jan. 30, 2001

(54) V-TYPE ENGINE

(75) Inventors: Hayato Matsuda; Hideo Shigedomi, both of Wako (JP)

(73) Assignee: Honda Giken Kogyo Kabushiki Kaisha, Tokyo (JP)

( * ) Notice: Under 35 U.S.C. 154(b), the term of this patent shall be extended for 0 days.

(21) Appl. No.: 09/421,289

(22) Filed: Oct. 20, 1999

(30) Foreign Application Priority Data

Oct. 20, 1998 (JP) ..... 10-298182

(51) Int. Cl.[7] ..... F02B 75/32; F02B 75/22

(52) U.S. Cl. ..... 123/54.4; 123/197.1; 123/197.3; 123/197.4

(58) Field of Search ..... 123/197.1, 197.4, 123/197.3, 54.4

(56) References Cited

U.S. PATENT DOCUMENTS 4,656,991 * 4/1987 Fukuo et al. ..... 123/572
5,513,601 * 5/1996 Benson ..... 123/54.4
5,537,971 * 7/1996 Pong ..... 123/197.4
5,615,642 * 4/1997 Coughlin ..... 123/54.4
5,941,205 * 8/1999 Hiraoka et al. ..... 123/184.35
6,044,818 * 4/2000 Decuir ..... 123/192.1

FOREIGN PATENT DOCUMENTS 61-291734 12/1986 (JP) .

* cited by examiner

*Primary Examiner*—Andrew M. Dolinar
*Assistant Examiner*—Katrina B. Harris
(74) *Attorney, Agent, or Firm*—Arent Fox Kintner Plotkin & Kahn, PLLC

(57) ABSTRACT

In a V-type engine including first and second pistons connected to a common crank pin of a crankshaft through first and second connecting rods, a large end of each of the connecting rods is formed so that its lower surface assumes a substantially horizontal attitude at a most-lowered position of the crank pin. This ensures that even if the construction is such that the large ends of the conducting rods do not contact with a defined amount of oil stored in lower portion of a crankcase in the V-type engine, the lower portion of the crankcase can be formed at a small depth, thereby lowering the entire height of the V-type engine.

5 Claims, 4 Drawing Sheets

V-TYPE ENGINE

BACKGROUND OF THE INVENTION

1. Field of the Invention

The present invention relates to a V-type engine including a first bank and a second bank which are disposed in a V-shape on opposite sides of a vertical line passing through the center of a crankshaft carried in a crankcase, the banks being formed continuously with the crankcase, and a first piston and a second piston which are fitted in cylinder blocks of the first and second banks, respectively and which are connected to a common crank pin of the crankshaft through first and second connecting rods, respectively.

2. Desription of the Related Art

Such V-type engines are known, as disclosed, for example, in Japanese Patent Application Laid-open No.61-291734.

Such V-type engine is effective to suppress the entire height of the engine to a low level, while permitting the number of cylinders to be increased by virtue of the inclined attitude of each of the banks, but if the lower portion of the crankcase can be formed at a small depth, the entire height of the engine can be further lowered.

However, a defined amount of oil corresponding to the capacity of the engine is generally stored in the lower portion of the crankcase. For this reason, there is a certain limit to forming the lower portion of the crankcase at a small depth. Especially, when it is desired that the surface of the oil does not contact with a large end of the connecting rod in order to eliminate the loss of power due to the agitation of the oil during rotation of the engine, it is further difficult to decrease the depth of the lower portion of the crankcase.

SUMMARY OF THE INVENTION

Accordingly, it is an object of the present invention to ensure that the defined amount of oil stored in the lower portion of the crankcase is not agitated by the large end of the connecting rod, thereby preventing the loss of power, and the lower portion of the crankcase can be formed at a small depth, thereby lowering the entire height of the engine and providing a compactness of the engine.

To achieve the above object, according to a first aspect and feature of the present invention, there is provided a V-type engine including a first bank and a second bank which are disposed in a V-shape on opposite sides of a vertical line passing through the center of a crankshaft carried in a crankcase, said banks being formed continuously with the crankcase, and a first piston and a second piston which are fitted in cylinder blocks of the first and second banks, respectively and which are connected to a common crank pin of a crankshaft through first and second connecting rods, respectively, wherein large ends of the connecting rods, which are connected to the crank pin, are formed so that their lower faces assume a substantially horizontal attitude at a most-lowered position of the crank pin, and a defined amount of oil is stored in a lower portion of the crankcase, so that the oil does not contact with the large ends of the connecting rods.

With the first feature, the large ends of the connecting rods cannot contact with the surface of the oil stored in the lower portion of the crankcase, thereby making it possible to avoid a loss of power due to the agitation of the oil and to contribute to an enhancement in power performance. Moreover, when the crank pin is brought into the most-lowered position, the distance between a horizontal plane tangent to the lowermost end points of the large ends of the connecting rods and the center of the crank pin can be minimized, and the lower portion of the crankcase for storing the defined amount of oil can be formed at a corresponding decreased depth, thereby lowering the entire height of the engine and providing a compactness of the engine.

According to a second aspect and feature of the present invention, each of the large ends is comprised of a large end half formed integrally on a connecting rod body and having a semi-circumferential bearing surface conformed to a semi-circumferential surface of the crank pin, and a cap bolted to the large end half and having a semi-circumferential bearing surface conformed to the other semi-circumferential surface of the crank pin, a joint face between the large end half and the cap being formed in parallel to the lower surface of the large end.

With the second feature, even if the joint face is inclined with respect to an axis of the rod body due to the construction of the large end of the connecting rod, the cap can be maintained in a laterally symmetric shape as in the conventional cap, and the formation and the machining thereof can be achieved easily.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

Figure 1:
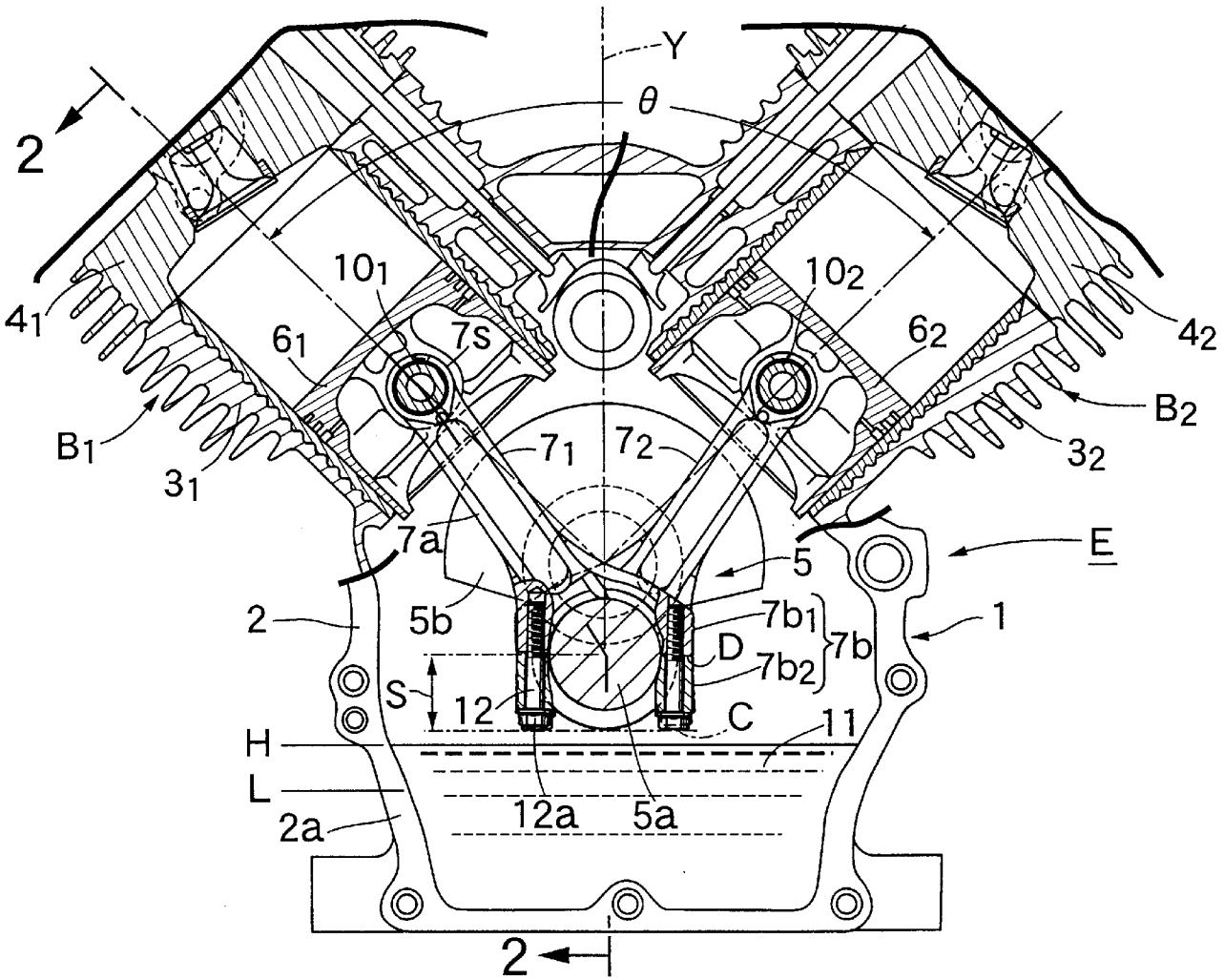
FIG. 1 is a cross-sectional front view of a V-type engine according to an embodiment of the present invention.

Referring first to FIG. 1, an engine body 1 of a V-type engine is comprised of a crankcase 2, a pair of left and right cylinder blocks $\mathbf{3}_1$ and $\mathbf{3}_2$ integrally formed in a V-shape at an upper portion of the crankcase 2, and cylinder heads $\mathbf{4}_1$ and $\mathbf{4}_2$ bonded to upper ends of the cylinder blocks $\mathbf{3}_1$ and $\mathbf{3}_2$. The left cylinder block $\mathbf{3}_1$ and cylinder head $\mathbf{4}_1$ constitute a first bank $B_1$, and the right cylinder block $\mathbf{3}_2$ and cylinder head $\mathbf{4}_2$ constitute a second bank $B_2$. The banks $B_1$ and $B_2$ are disposed to form an included angle $\theta$ of 90° therebetween, and a vertical straight line Y passing through the center of a crankshaft 5 carried in the crankcase 2 is a line bisecting the included angle $\theta$.

Figure 2:
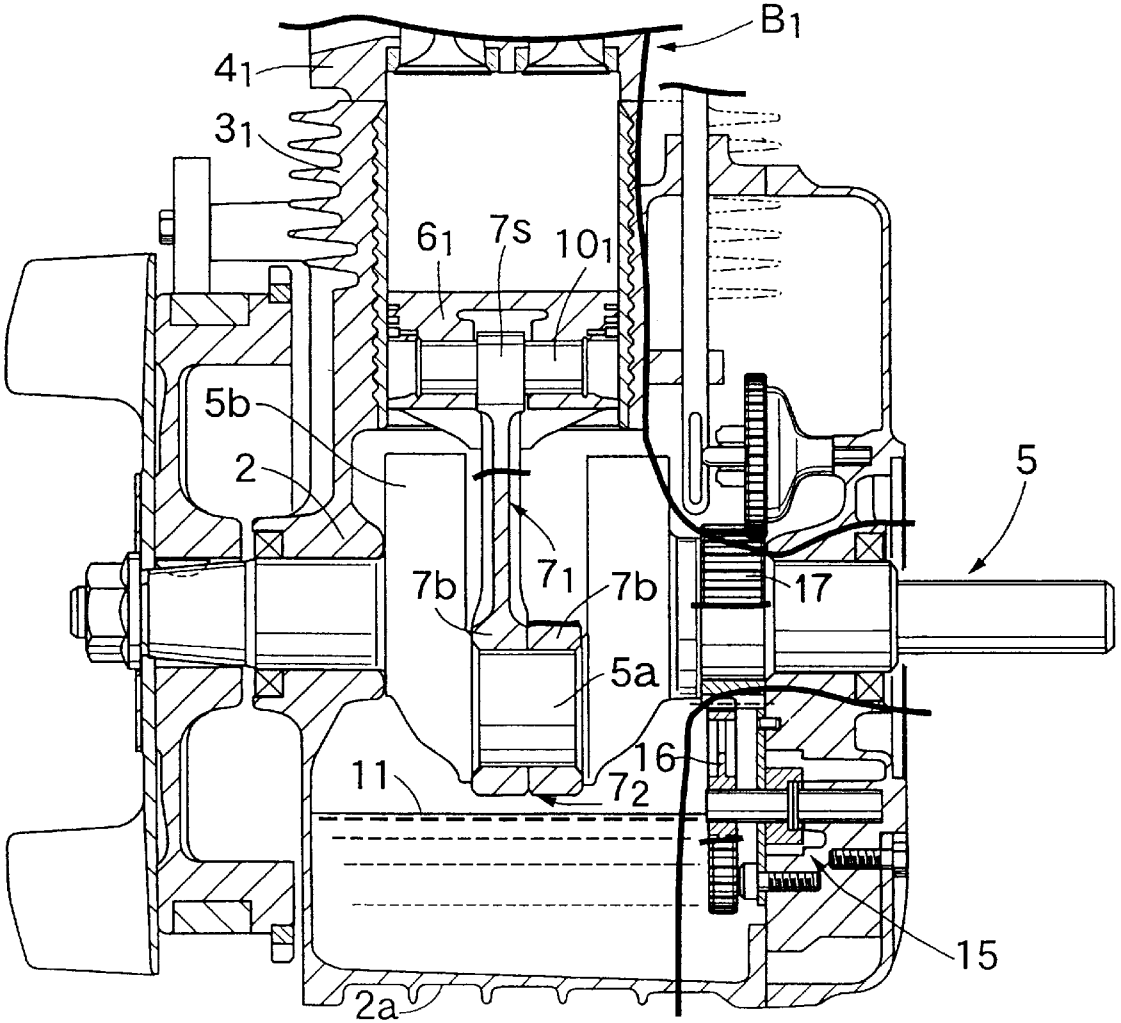
FIG. 2 is a sectional view taken along a line 2—2 in FIG. 1.

Connecting rods $\mathbf{7}_1$ and $\mathbf{7}_2$ are connected at smaller ends 7*s*, 7*s* thereof through piston pins $\mathbf{10}_1$ and $\mathbf{10}_2$ to pistons $\mathbf{6}_1$ and $\mathbf{6}_2$ fitted in the cylinder blocks $\mathbf{3}_1$ and $\mathbf{3}_2$ of the first and second banks $B_1$ and $B_2$, and at their larger ends 7*b*, 7*b* to a common crank pin 5*a* of the crankshaft 5 (see FIG. 2).

As shown in FIGS. 1 and 2, a lower portion of the crankcase 2 is formed as an oil reservoir 2*a* in which a defined amount of oil 11 is stored. An oil pump 15 for pumping the oil 11 to supply it to various portions of the engine E is mounted to an inner wall of the crankcase 2 and is driven through a pair of gears 16 and 17 from the crankshaft 5.

Figure 3:
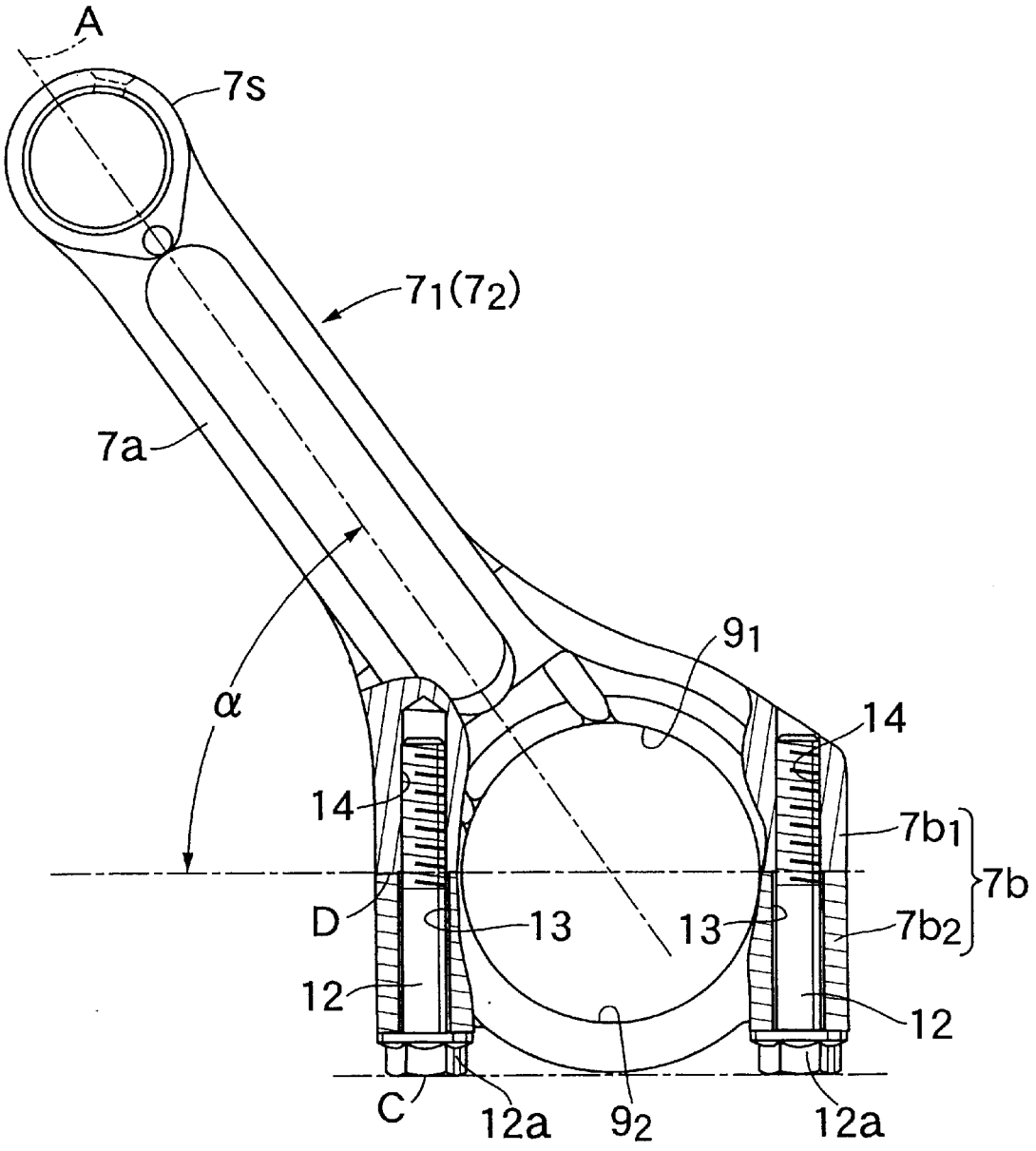
FIG. 3 is a front view of a connecting rod in the engine with a portion being sectioned vertically.

As shown in FIGS. 1 and 3, the large ends 7*b* of each of the connecting rods $\mathbf{7}_1$ and $\mathbf{7}_2$ is comprised of a large end half $\mathbf{7}b_1$ integrally formed on a connecting rod body 7*a* and having a semi-circumferential bearing surface $\mathbf{9}_1$ conformed to a semi-circumferential surface of the crank pin 5*a*, a cap $\mathbf{7}b_2$ having a semi-circumferential bearing surface $\mathbf{9}_2$ conformed to the other semi-circumferential surface of the crank pin 5*a*, and a pair of bolts 12, 12 for coupling the larger end half $\mathbf{7}b_1$ and the cap $\mathbf{7}b_2$ to each other. The pair of bolts 12, 12 are inserted through bolt bores 13, 13 in opposite ends of the cap $\mathbf{7}b_2$ and threadedly fastened in threaded bores 14, 14 in opposite ends of the larger end half $\mathbf{7}b_1$, respectively, so that the pair of bolts 12, 12 are disposed in parallel to each other with the crank pin 5*a* interposed therebetween. Each of end faces of heads 12*a*, 12*a* of the bolts 12, 12 forms a lower face C of the large end 7*b*. The lower face C is formed so that it is parallel to a joint face D between the larger end half $\mathbf{7}b_1$, and the cap $\mathbf{7}b_2$ and substantially horizontal at a most-lowered position of the crank pin 5*a*. To ensure this, in the case of the V-type engine E, the angle $\alpha$ of inclination of the joint face D and the lower face C with respect to an axis A of the connecting rod body 7*a* is set at approximately 50°.

On the other hand, the oil reservoir has such a capacity provided that even when the oil 11 is accommodated in an amount reaching an upper limit level H, the lower face C of the larger end 7*b* does not contact with the oil surface. Reference character L designates a lowest limit level of the oil 11.

A crank web 5*b* of the crankshaft 5 is also formed so that it does not contact with the oil 11 in the oil reservoir 2*a* during rotation of the crankshaft 5.

The operation of this embodiment will be described below.

During operation of the engine E, the oil pump 15 driven from the crankshaft 5 pumps the oil 11 in the oil reservoir 2*a* to supply it to various portions of the engine E and hence, these various portions can be reliably lubricated.

On the other hand, the large ends 7*b* of the connecting rods $\mathbf{7}_1$ and $\mathbf{7}_2$ and the crank web 5*b* do not contact with the liquid surface of the oil 11 stored in the oil reservoir 2*a* and hence, it is possible to avoid the loss of power due to the agitation of the oil 11 by the large ends 7*b* and the crank web 5*b*, which can contribute to an enhancement in power performance.

Moreover, the lower face C of the large end 7*b* of each of the connecting rods $\mathbf{7}_1$ and $\mathbf{7}_2$ is formed so that it is substantially horizontal at the most-lowered position of the crank pin 5*a*, and hence, when the crank pin 5*a* is brought into the most-lowered position, the distance S from a horizontal plane tangent to the lowermost end points of the large ends 7*b* of the connecting rods $\mathbf{7}_1$ and $\mathbf{7}_2$ to the center of the crank pin 5*a* can be minimized, and the oil reservoir 2*a* having the defined capacity can be provided correspondingly close to the crankshaft 5, i.e., the depth of the lower portion of the crankcase 2 can be decreased, thereby lowering the entire height of the engine and providing a compactness of the engine.

Figure 4:
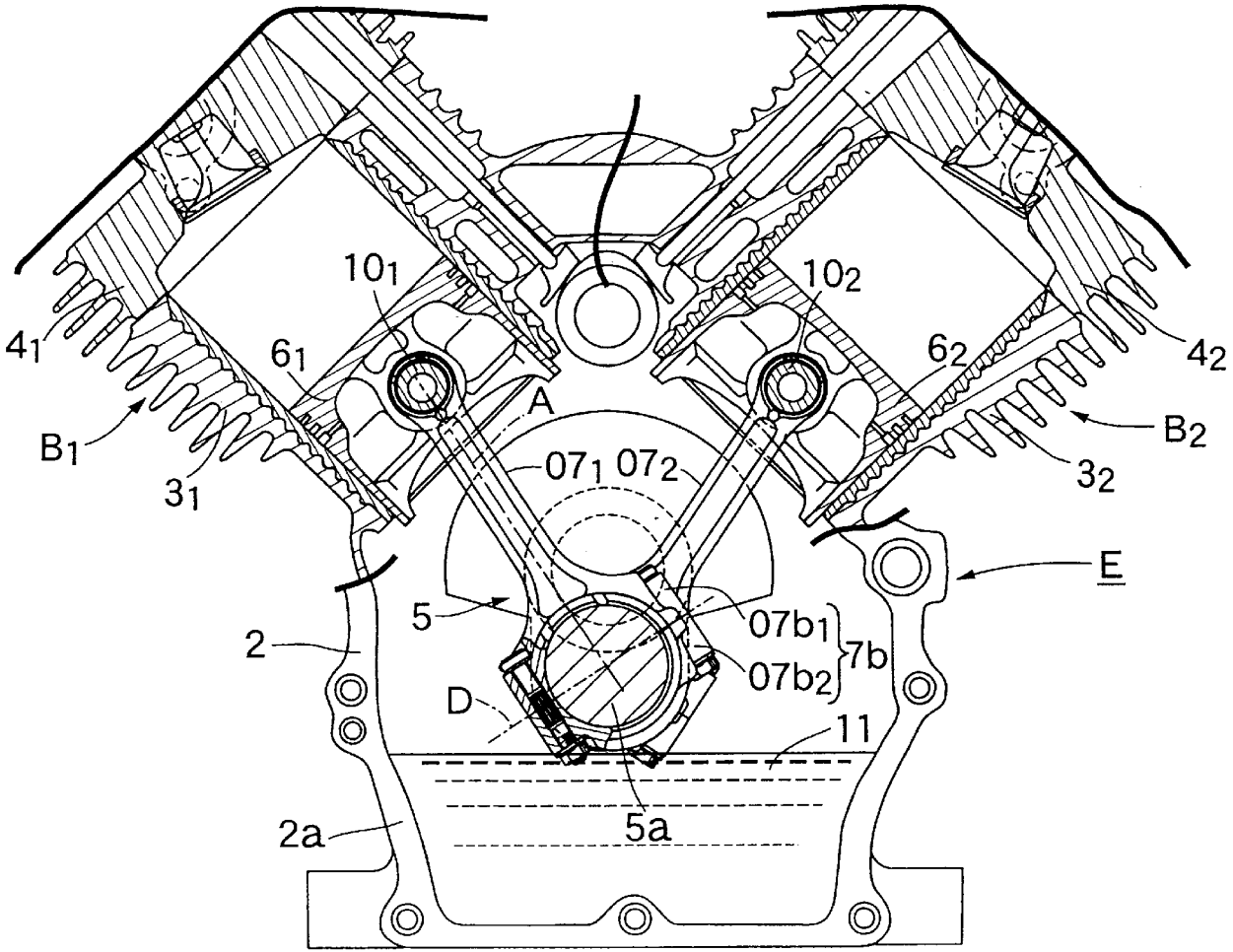
FIG. 4 PRIOR ART
FIG. 4 is a reference view showing the mentioned V-type engine but with conventional connecting rods assembled thereto.

FIG. 4 shows the V-type engine according to the present invention, to which conventional connecting rods $\mathbf{07}_1$ and $\mathbf{07}_2$ are assembled with a joint face D between a large end half $\mathbf{07}b_1$ and a cap $\mathbf{07}b_2$ being perpendicular to an axis A of a connecting rod body 07*a*. As can be seen from FIG. 4, in such a case, unless the depth of the lower portion 2*a* of the crankcase 2 is increased, or the amount of oil 11 stored in the crankcase 2 is decreased, the large ends 07*a* of the connecting rods $\mathbf{7}_1$ and $\mathbf{7}_2$ agitate the oil 11 during rotation of the crankshaft 5, thereby bringing about a loss of power.

In addition, according to the present invention, the lower face C of the large end 7*b* of each of the connecting rods $\mathbf{07}_1$ and $\mathbf{07}_2$ is formed in parallel to the joint face D between the large end half $\mathbf{7}b_1$ and the cap $\mathbf{7}b_2$ constituting the large end 7*b*. Therefore, even if the joint face D is inclined with respect to the axis A of the connecting rod body 7*a* as described above, the cap $\mathbf{7}b_2$ can be maintained in a laterally symmetrical shape, as in the conventional common cap and hence, the formation and machining of the cap $\mathbf{7}b_2$ can be easily achieved.

Although the embodiment of the present invention has been described in detail, it will be understood that the present invention is not limited to the above-described embodiment, and various modifications in design may be made without departing from the spirit and scope of the invention defined in claims. For example, the oil reservoir 2*a* of the crankcase 2 can be replaced by an oil pan.

What is claimed is:

1. A V-type engine comprising a first bank and a second bank which are disposed in a V-shape on opposite sides of a vertical line passing through a center of a crankshaft carried in a crankshaft, said banks being formed continuously with said crankshaft, and a first piston and a second piston which are fitted in cylinder blocks of said first and second banks, respectively and which are connected to a common crank pin of said crankshaft through first and second connecting rods, respectively, wherein large ends of said connecting rods, which are connected to said crank pin, are formed so that lower faces of said large ends assume a substantially horizontal attitude as viewed from a crankshaft end at a most-lowered position of said crank pin, and a defined amount of oil is stored in a lower portion of said crankcase, so that the oil does not contact with said ends of said connecting rods.

2. A V-type engine according to claim 1, wherein each of said large ends is comprised of a large end half formed integrally on a connecting rod body and having a semi-circumferential bearing surface conformed to a semi-circumferential surface of said crank pin, and a cap bolted to said large end half and having a semi-circumferential bearing surface conformed to another semi-circumferential surface of said crank pin, a joint face between said large end half and said cap being formed in parallel to said lower face of said large end.

3. A V-type engine according to claim 2, wherein said cap is bolted by bolts to said large end half and said lower face of said large end of the connecting rod is defined by a plane on which heads of said bolts lie.

4. A V-type engine according to claim 3, wherein said lower face of said large end extends substantially parallel to a surface of oil stored in the crankcase.

5. A V-type engine according to claim 1, wherein said large end of each said connecting rod comprises a large end half integral with a connecting rod body and a cap connected to said large end half by bolts, and said lower face of said large end is defined by a plane connecting heads of said bolts.

* * * * *